United States Patent [19]

Csaky et al.

[11] 4,288,977

[45] Sep. 15, 1981

[54] PROCESS FOR MAKING INTEGRATED RACKET STRINGS FROM MONOFILAMENTS

[75] Inventors: Thomas J. Csaky, Richmond; Sibbley P. Gauntt, Bon Air; Ralph L. Heard, Jr., Richmond, all of Va.

[73] Assignee: E. I. Du Pont de Nemours and Company, Wilmington, Del.

[21] Appl. No.: 139,112

[22] Filed: Apr. 10, 1980

[51] Int. Cl.[3] ..... D01H 13/30; D02G 3/40

[52] U.S. Cl. ..... 57/297; 57/248; 57/251

[58] Field of Search ..... 57/295, 297, 6, 7, 242, 57/248, 251, 90; 428/397, 375, 380, 383

[56] References Cited

U.S. PATENT DOCUMENTS

| | | | |
|---|---|---|---|
| 3,041,915 | 7/1962 | Ryffel | 428/397 X |
| 3,347,036 | 10/1967 | Daniel | 428/397 X |
| 3,738,096 | 6/1973 | Crandall | 57/242 |
| 3,777,470 | 12/1973 | Suzuki et al. | 57/297 |
| 3,908,351 | 9/1975 | Carroll | 57/297 |
| 4,055,941 | 11/1977 | Rivers, Jr. et al. | 57/248 |

*Primary Examiner*—John Petrakes

[57] ABSTRACT

The quality of a resin-bonded twisted string comprised of three flattened monofilaments in a side-by-side relationship is improved when the monofilaments are precoated with resin prior to twisting and then twisted in a zone wherein the excess lengths of the two outer monofilaments in the twisted configuration is compensated for during twisting by forwarding the two outer monofilaments at a positively controlled speed and allowing the speed of the middle monofilament to be controlled by being drawn into the twisting zone through a roller slot guide at a speed freely determined relative to the speed of the two other monofilaments entering the twisting zone.

4 Claims, 4 Drawing Figures

PROCESS FOR MAKING INTEGRATED RACKET STRINGS FROM MONOFILAMENTS

DESCRIPTION

1. Technical Field

This invention relates to a process for making twisted strings from large monofilaments. More particularly, it relates to an improved process for twisting and bonding large flat monofilaments together to make an integrated string suitable for use in game rackets such as for tennis.

2. Background Art

U.S. Pat. No. 4,055,941 (Rivers et al.) describes an integrated string for use in rackets comprised of from 2 to 4 monofilaments of an oriented synthetic thermoplastic polymer and each having a denier of from 2,000 to 8,000 and 2 opposite flattened sides throughout its length. In the string the monofilaments have no individual twist with respect to one another but are ply-twisted and bonded together throughout the length of the string with each monofilament being bonded along one of its flattened sides to at last one other monofilament. As taught in the patent, the strings are prepared by twisting the monofilaments together and passing the twisted string through a bath containing an adhesive resin and through a curing oven which both heat-relaxes the monofilaments and bonds them together. When such strings are prepared from three monofilaments arranged as a middle monofilament sandwiched between two outer monofilaments, as shown for instance in FIG. 3 of the patent, special precautions must be taken during twisting to assure that this configuration is consistently obtained. This is due to the fact that when the three monofilaments arranged in this manner are twisted together, the middle monofilament is twisted substantially about its own longitudinal axis whereas the outer two monofilaments must wrap around the middle monofilament. Consequently, the two outer monofilaments in a given length of string must be slightly longer than the middle monofilament. Therefore, during twisting it is necessary that the two outer monofilaments be fed to the twisting zone at a slightly faster speed than that of the middle monofilament in order to compensate for this length differential. Maintaining the required speed differential is difficult particularly on sustained runs which are subject to the accumulative effects of variations in the speeds and dimensions of the monofilaments. Such variations can cause unacceptable increases or decreases in tension of individual filaments making them difficult to control and leading to nonuniformities in twist and configuration of the string, if not breakdown of the process.

In addition to uniformity problems, strings are susceptible to loss of adhesion between monofilaments under the severe stresses of racket stringing. The application of more adhesive resin to the string for more adhesion is a limited solution since more adhesive increases the size of the string and makes stringing of rackets even more difficult because of limitations on the size of holes in the racket frame.

An object of the present invention is a process for consistently making with high productivity a racket string from three flattened monofilaments which string has improved resistance to the stresses of racket stringing and of game playing.

Another object of the present invention is to insure that the twisted product contains the monofilaments in their desired side-by-side relationship with the designated monofilament always in the middle position.

Other objects are to provide strings having uniform breaking strengths and a twisting process having reduced tendency to damage the monofilaments.

DISCLOSURE OF INVENTION

Figure 1:
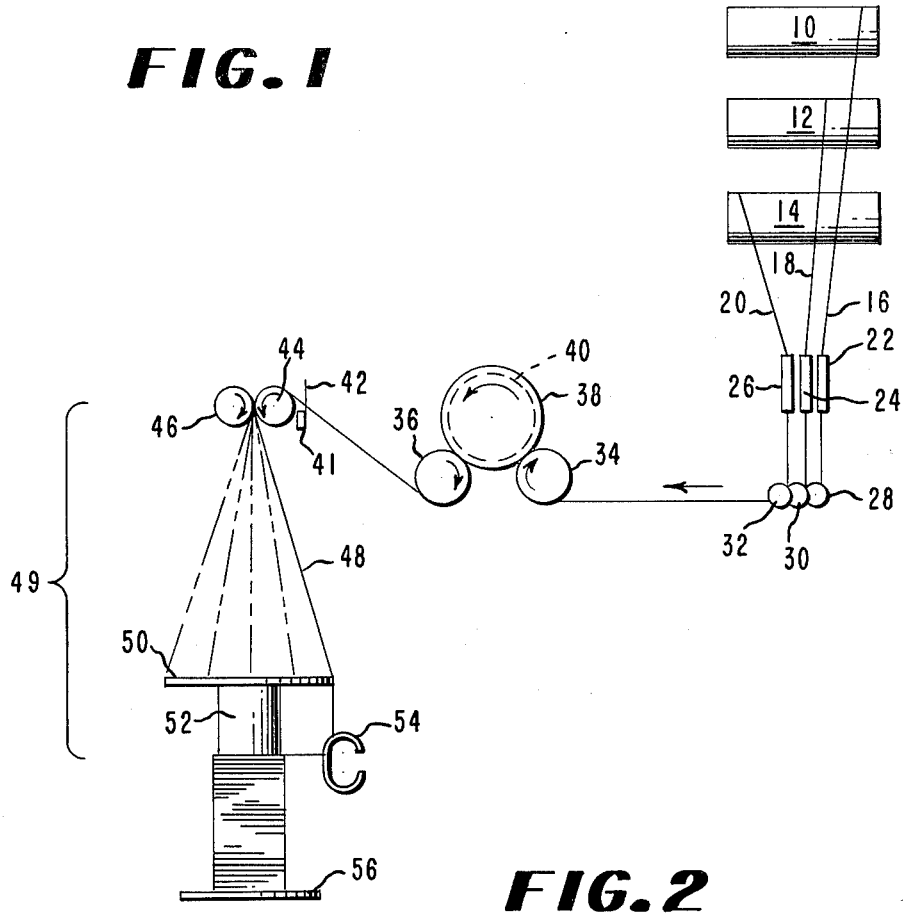
FIG. 1 is a schematic representation of a process for twisting precoated monofilaments into a string according to that feature of this invention.

This invention provides an improved process for making an integrated twisted string comprised of a middle flattened monofilament sandwiched between two outer flattened monofilaments, with each monofilament having a denier within the range of 3,000 to 8,000 and two opposite flattened sides throughout its length. The steps include aligning the monofilaments edge-to-edge and forwarding them into a twisting zone through a slot guide having a slot width which is greater than the thickness of the thickest of the monofilaments to allow free passage of all monofilaments but less than the total thickness of two adjacent monofilaments so that said monofilaments cannot cross over one another in said slot as they are forwarded into the twisting zone, compensating for the greater lengths required for the two outer monofilaments in the resulting twisted string configuration by separately controlling the speeds and tensions of the monofilaments on their way to said zone, twisting the monofilaments together in the twisting zone, and bonding them to one another by means of a heat-activated adhesive resin to form an integrated twisted string, wherein the improvement comprises the sequential steps of: (1) applying to the surface of at least the monofilament which is to become the middle monofilament a continuous dry thin coating of a heat-activated adhesive resin; (2) aligning the three monofilaments edge-to-edge in a common plane slightly separated from one another and with the middle monofilament positioned between the two outer monofilaments and forwarding under separately controlled speeds and tensions the thus aligned and separated monofilaments into a twisting zone through said slot formed between two axially parallel freely-rolling cylindrical surfaces; (3) compensating for the excess length in the two outer monofilaments by forwarding them at a positively controlled speed and allowing the speed of the middle monofilament to be freely controlled by being drawn into the twisting zone through said slot at a relative rate determined by the speed of the two outer monofilaments and by the twisting action in said zone while maintaining a tension on the middle monofilament which is no greater than the tension maintained on each of the two outer monofilaments as they enter said zone so that the speed of the middle monofilament entering said zone is always slightly less by the required amount than that of the two outer monofilaments; (4) twisting said monofilaments together into a string in said zone in a sandwiched configuration with each flattened side of the twisted coated middle monofilament maintaining continuous contact throughout its length in the string with a flattened side of a corresponding adjacent outer monofilament; and (5) heating the twisted string under controlled tension at a temperature which activates said adhesive resin and bonds the monofilaments together.

The application of the adhesive resin to at least the middle monofilament with drying or in a dry state prior to twisting increases the uniformity and strength of the bonding without significantly increasing the overall amount of adhesive required. For even greater durability and performance under severe conditions of use, such as in a tennis racket for a hard hitting player, it is preferred to precoat all of the monofilaments and to also apply and cure additional adhesive on the string after twisting. The adhesive applied after twisting may be of the same or different composition with respect to the precoating.

The full advantages of precoating the monofilaments prior to twisting are realized when the adhesive resin is applied and allowed to dry to remove volatile solvent or dispersion medium before twisting. The adhesive may be applied by melt coating, such as by wire coating techniques, or by applying from a solution or dispersion and subsequently removing volatile inert ingredients such as by heating. Of course, the adhesive must be capable of being activated upon heating of the twisted string. With the improved adhesion provided by this invention, not only is better bonding possible but also greater freedom is provided with respect to subsequent overlay coatings. Their selection, for example, can be based among other things on properties other than adhesion such as toughness and lubricity for improved wear resistance.

Another important aspect of the invention, in addition to precoating, is the manner in which the coated monofilament, or monofilaments, is introduced into the twisting zone to insure the desired string configuration; that is the side-by-side sandwiched structure. The precoating operation makes this more difficult because it changes frictional characteristics and the dimensions of the filaments; whereas attaining the desired configuration is dependent upon precise matching of the relative speeds of the monofilaments on a sustained basis for a given size and configuration. Therefore, any variations in the thickness of the coating will complicate the twisting operation. It has now been discovered that this complication and frictional problems can be satisfactorily controlled by positively controlling the speeds of the two outer monofilaments while leaving the middle monofilament free to respond to minor dimensional variations of the monofilaments in the twisting zone by allowing it to be freely drawn into the twisting zone as determined by the speed of the outer monofilaments. Therefore, the middle monofilament should not have its speed positively regulated such as by a driven nip roll; for example, it must be free to slip or change its speed as necessary. This is accomplished by maintaining a tension on the middle monofilament which is no greater than and preferably less than that of the two outer monofilaments by an independent tension control means and by using low friction contact surfaces as necessary such that they do not restrict free movement of the middle monofilament with respect to entering the twisting zone.

Figure 2:
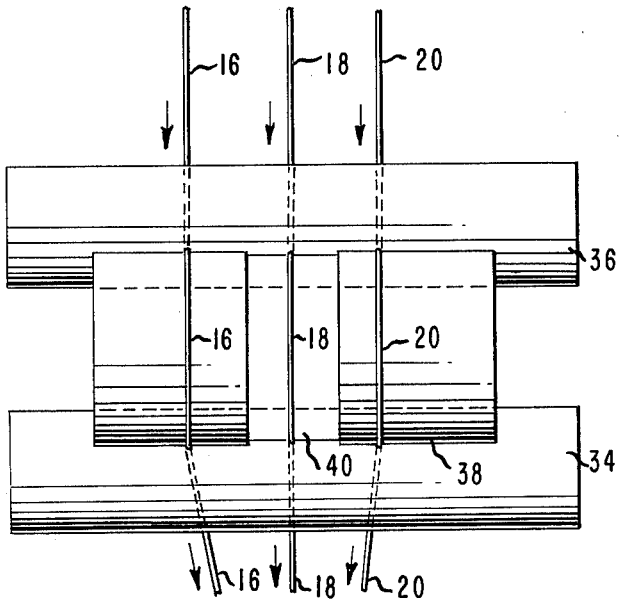
FIG. 2 is a top view of a feed roll and grooved cot roll arrangement in use as shown in FIG. 1 for positively controlling the speed of the two outer monofilaments during twisting.

Referring to FIG. 1, a process of the invention is schematically illustrated to show three supply packages of monofilaments 10, 12 and 14 containing monofilaments 16, 18 and 20, respectively. The supply packages may be of any suitable nature such as of a cross-wound monofilament on a straight paper tube or of parallel wound spools. The monofilaments may be of the same or different deniers provided they otherwise meet the requirements of the invention; their sizes must be compatible with respect to obtaining the desired configuration, for example, two outer 4200 denier monofilaments may be combined with one 3,000 denier middle monofilament. The monofilaments pass through tension devices 22, 24 and 26 and then around ceramic spool guides 28, 30 and 32, respectively. Grooved spool guides are preferred. The monofilaments then pass under and partially around a polished chrome feed roll 34 which is maintained at a predetermined surface speed and then over and partially around cot roll 38 having a smaller middle portion 40 of smaller diameter forming a groove. At this point, the monofilaments are separated from one another such that outer monofilaments pass around the larger end portions of one cot roll 38 while the middle monofilament 18 passes around the smaller mid portion 40 as shown in FIG. 2. Therefore only outer monofilaments 16, 20 are nipped between cot roll 38 and feed rolls 34, 36. The monofilaments then continue under and partially around second polished chrome feed roll 36.

As monofilaments 16, 18, 20 proceed they next pass individually between separated vertical guide pins 42 attached to guide pin base 41. The vertical pins, such as from a fine tooth beamer comb guide, guides the filaments into the following roller slot guide assembly. The filaments enter the slot guide close to but separate from one another. The filaments next pass over first idler roll 44 and between it and second idler roll 46, which are spaced with respect to one another to form a narrow slot as shown in FIG. 3 which allows the filaments to pass freely but prevents them from crossing one another or prevents twisted monofilament from passing between the two rolls.

Figure 3:
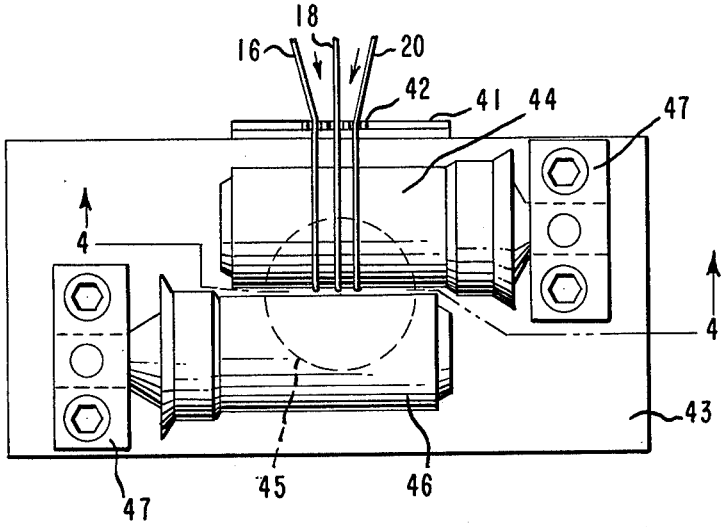
FIG. 3 is a top view of a roller slot guide assembly in use as shown in FIG. 1 for guiding monofilaments into the twisting zone according to this invention.

As shown in FIG. 3, the roller slot guide assembly includes a base plate 43 to which is fastened comb guide base 41. Fastened also to base plate 43 are brackets 47 which hold idler rolls 44 and 46 so that these rolls are axially parallel to one another and spaced as described above herein. Beneath rolls 44, 46 in base plate 43 is located an opening 45 for passage of the monofilaments from between idler rolls 44, 46 into twisting zone 49.

Referring back to FIG. 1, twisting zone 49 includes a conventional twister spool 52 mounted on a rotating twister spindle (not shown) and having a flange 50 over which twisted string 48 passes and then through one or more travellers 54 of proper total weight to provide the desired twisting performance. The remainder of the conventional downtwister apparatus is not shown.

Figure 4:
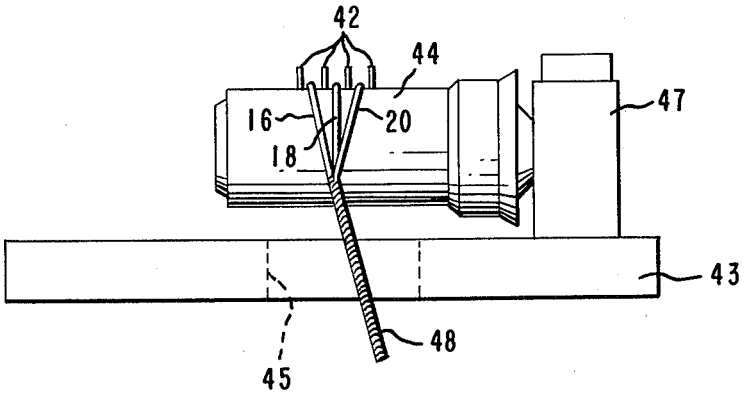
FIG. 4 is a section front view of the rear roll in the roller slot guide assembly taken along lines 4—4 of FIG. 3 and shows the monofilaments converging into the twisted string as they enter the twisting zone.

As shown in FIG. 4, monofilaments 16, 18 and 20 twist together to form twisted string 48 as they leave the slot formed between idler rolls 44, 46 and pass through opening 45 in base plate 43. Because of their spacing idler rolls 44, 46 prevent the formation of any twist in the monofilaments from the twister before they enter the twisting zone. Because of the large travellers required to twist the heavy monofilaments of this invention, it may be necessary that bottom flange 56 of spool 52 be reduced in size in order to clear large traveller 54, or travellers, when being placed in and removed from the twisting position.

It is necessary for this invention that middle monofilament 18 be free to be freely drawn into the twisting zone under low tension substantially as regulated only by tensioning device 24. Consequently, it is preferred that the surface of groove 40 be covered with a low friction material such as polytetrafluoroethylene so that the monofilament is free to slip thereon and its speed not limited to that of the surface speed of the rolls. Also note that in the arrangement shown in FIG. 1, because middle monofilament 18 is moving more slowly than that of monofilaments 16 and 20 (which are moving at the surface speed of feed rolls 34, 36), monofilament 18 must also slip slightly on the surface of rolls 34, 36. In an alternate arrangement middle monofilament 18 may completely bypass feed rolls 34, 36 and cot roll 38 so that it goes directly from tension device 24 by any appropriate guide means to the roller slot guide assembly.

Under certain circumstances it may be desirable to backwind the monofilaments onto parallel-wound flanged spools for use in this invention. For instance, if the monofilaments have been cross-wound on flangeless paper tubes and have developed crimps because of long storage, such crimps can cause jerks in the supply tension. For the outer monofilaments such jerks can be controlled by the nipping action of the cot and feed rolls; however, since the middle monofilament is not nipped the jerks can be passed on to the twisting zone. Irregularities in feeding tension from the supply spools can be effectively controlled with tension devices as shown in FIG. 1, e.g., using tensions such as 100 to 300 grams for a middle 3,000 denier monofilament and from 200 to 500 grams for each of two outer 4200 denier monofilaments. Also, some tension is added by spool guides 28, 30 and 32. With parallel-wound uncrimped monofilament supply packages little, if any tension, needs to be added for smooth operation.

If the monofilaments are spread too widely apart upon entering the roller slot guide assembly, they converge and begin twisting well below the guide rolls, which can lead to instability. Consequently, it is preferred that the filaments be converged to within about ⅛ inch (3.2 mm.) of each other just ahead of the roller slot such as by using 1/16 inch (1.6 mm.) diameter chrome pins. Closer spacing can be used with appropriate apparatus.

Conventional ¾ inch (19.1 mm.) diameter idler rolls may be used for the roller slot guide in this invention and are readily available. Idler roll design is not considered limiting since process speeds and loads are low. It is important that the rollers be aligned horizontally and parallel to each other and to the preceding feed roll to prevent the monofilaments from splaying out of the slot.

Because of the nature of the large monofilaments heavy travellers are used on the twisting position; for example two Merriman Pirouette® PS 1250 SZ 10J. The use of three such travellers as PS 420 SZ 10J is preferred for better uniformity.

Monofilaments for use in the process of this invention must have no individual twist which would interfere with the necessary alignment in the twisted string. The monofilaments have a substantially uniform ribbon-like or so-called obround cross-section along the monofilament with two opposite flattened sides giving a length-to-width ratio for the cross-section of from 2 to 4. The cross-section of course is measured at right angles to the filament axis. Such cross-sectional shapes include known ribbon, oblong, obround and equivalent cross-sections where the flattened sides are, at most, only slightly curved. Strings made by this invention are particularly suitable for use in squash and tennis rackets when containing three monofilaments each having a denier of about 3,000 to about 4,200.

Monofilaments comprised of synthetic linear polyamides such as 6-nylon and 66-nylon are preferred for toughness.

Strings prepared by this invention can employ a relatively small amount of twist compared to conventional strings ply-twisted from multifilament yarns. Therefore, twist within the range of from about 1 to about 4 turns per inch (0.4 to 1.6 turns per cm.) is preferred. Conventional up-twist or down-twist apparatus may be used for twisting.

The particular adhesive resin selected for use in this invention depends upon the polymer from which the monofilaments are made and its selection is well within the capability of one knowledgeable with respect to such adhesion requirements. Solvent based or aqueous latex based adhesive resin compositions can be employed with the limitation as described herein that any solvent or aqueous medium be removed to leave a dry resin coating on the monofilaments before they are combined for twisting. For polyamide monofilaments, polyurethane based resins and polyamide copolymer resins marketed for polyamide adhesive applications have been found to be suitable.

Monofilaments particularly suitable for this invention because of their strength, toughness and durability include synthetic polyamide monofilaments as described in U.S. Pat. No. 3,650,884 to Hansen and in U.S. Pat. No. 4,056,652 to Gauntt. Such monofilaments have improved knot strength as the result of a special steam treatment. Monofilaments for use in this invention, however, may be comprised of any oriented, synthetic thermoplastic polymer providing sufficient tensile properties for the use intended. Such polymers include polyethylene, polypropylene, polyesters and polyamides.

Integrated strings prepared by the process of this invention may be used with or without additional top coatings, wrappings, or overbraiding materials as known in the art.

In the following examples, the strength of adhesion between monofilaments in the twisted and bonded string is determined by measuring the load required to separate one monofilament from the rest of the string in a tensile testing machine with the separating ends being maintained at about 180° angle with respect to one another and at an angle of 90° with respect to the bonded portion of the string being tested. The test is conducted with a machine such as an Instron® Tensile Tester, Instron Engineering Corp., Canton, Mass. using air-activated paper clamps 1 inch by 1½ inch (2.54 by 3.8 cm.) with rubber faced jaws. The test is run with a cross head speed of 5 inches (12.7 cm.) per minute using a "C" or "CT" load scale (200 lb. FSL) with the load selector set at 5 lbs. (~2.3 kg.) full scale load. The test specimen is prepared by cutting a 6 inch (15.2 cm.) length of the string to be tested and separating one monofilament from one end of the string until only about 1½ inch (3.8 cm.) of the specimen remains fully bonded. To maintain the three ends of the prepared specimen in their proper relationship to one another during the test, the sample is then placed in a tubular poly(tetrafluoroethylene) T-joint (coupling) which has been modified to facilitate insertion of the specimen. The T-joint, a standard coupling for plastic tubing and the like, has a ¼ inch (6.35 mm.) inside diameter with each branch of the "T" being about ⅝ inch (1.6 cm.) long. To facilitate placing of the sample in the "T" a narrow slot is cut along the full length of one side of the top cross-bar of the "T" and in the center of this cross-bar a short slot is cut from the side slot to the top center of the "T" so that the bonded end of the test specimen can be inserted through this top slot into the stem of the "T" and the separated ends of the specimen are placed at an angle of 180° to one another in the cross-bar of the "T". Consequently, the "T" maintains the bonded portion of the string at 90° to the separated ends and prevents the bonded portion from twisting around one of the separating ends during the test. The separated unbonded single monofilament is placed in one clamp of the machine and the other separated end is placed in the other clamp. The machine is then activated and the test run until the end of the fully bonded portion of the specimen enters the "T"; which means that about a 1 inch (2.54 cm.) length of the bonded specimen has been tested. The level of adhesion for this test length is determined by means of a computer such as a PDP-11 computer, Digital Equipment Corporation, Maynard, Mass. as the average of the force required to separate the ends for the duration of the test.

EXAMPLE 1

This example compares the adhesion between monofilaments in a bonded twisted string when adhesive resin is applied to and dried on the monofilaments prior to twisting and when applying resin to the string only after twisting.

Monofilaments of poly(hexamethylene adipamide), 66-nylon of the type prepared described and claimed in U.S. Pat. No. 4,056,652 (Gauntt) of 3000 denier and of 4200 denier are used. The middle monofilament is 3000 denier and the two outer monofilaments are 4200 denier. The monofilaments have an obround cross-section with width to thickness ratios of 2.69 and 2.49 for 3000 and 4200 deniers respectively. The 3000 denier one is 13.7 mils (0.35 mm.) thick and 36.9 mils (0.94 mm.) wide; the 4200 denier ones are 16.8 mils (0.43 mm.) thick and 41.8 mils (1.06 mm.) wide.

The adhesive resin is applied from an aqueous dispersion of a thermoplastic adhesive resin consisting of Genton® 110 (6,612 Nylon resin) containing 10 percent of the resin by weight.

Monofilaments are precoated with the adhesive as follows on a computreater Lab Cord processing unit, C. D. Litzler Co., Inc., Cleveland, Ohio, 44135:

| | No. 1 Oven | No. 2 Oven | No. 3 Oven |
|---|---|---|---|
| Filament Speed (ypm) | 20 | 20 | 20 |
| Stretch (%) | 1* | N/A** | 1.5 |
| Tension (grams) | | | |
| −3000 Denier | 1800 | 2100 | 2300 |
| −4200 Denier | 2400 | 2800 | 3700 |
| Temp., °F. (°C.) | 68 (20) | 400 (204) | 400 (204) |
| Residue Time (sec.) | N/A | 51 | 59 |
| Dip Pick Up (%) | N/A | N/A | 10 |
| Size Change (mils) | N/A | N/A | +1.8 |

*Only enough stretch is used to maintain the monofilament on the draw rolls.
**Not applicable.

The twisting conditions used for both precoated and nonprecoated monofilaments are the same, and consist basically of: feeding as shown in FIG. 1 three monofilaments to a roller slot guide by a cot roll with about 2% smaller middle diameter to meter the middle filament such that the speed ratio of middle to outer filaments is calculated to be about optimum for uniform twist and includes tension controls on all three monofilaments supplied to the cot roll. Twisting equipment and conditions for this work are:

Twister: Saco Lowell Downtwister
Cot Roll: Armstrong Accotex No. 728 with a reduced middle diameter.
Rings: 5½"×1" Double grease groove
Guide: Roller slot with slot width of 25±2 mils
Spindle Speed: 1475±50 rpm (3.5 tpi relaxed)
Twist Level: 2.9 tpi on unrelaxed (3.5 tpi relaxed) as twisted, cord
Tension Devices: Model No. UTC 2004, Steel Heddle Mfg. Co.
Travelers: Two PS 1250 SZ 10J, Merriman, Inc.

This twisting process is known to be satisfactory for uncoated monofilaments with frequent tension adjustments to compensate for along end, variation in monofilament cross-sectional dimensions. It is found to be unsatisfactory for sustained use with precoated monofilaments because the precoating process accentuates along end dimensional variations. During twisting runs using precoated monofilaments, the outer monofilaments frequently overfeed, and accumulate loops leading to nonuniform twist and twisting breakouts. Attempts to reduce the overfeed by altering the ratio of inner to outer cot roll diameters or by adjusting tensions are unsuccessful on a sustained basis; but some quantities of string are produced for test evaluation as described next.

Twisted strings of three monofilaments (4200-3000-4200) with and without precoating are heat relaxed 12% in the No. 1 oven, then two top coats applied with 20% urethane-latex adhesive resin from an aqueous dispersion. The same Litzler computreater is used for this work and conditions summarized as:

| | No. 1 Oven | No. 2 Oven | No. 3 Oven |
|---|---|---|---|
| String Speed (ypm) | 20–17.6 | 17.6 | 17.6 |
| Relaxation (%) | 12 | 0 | 0 |
| Tension (grams) | 800 | 1100 | 1300 |
| Temperature, °F. (°C.) | 460 (238) | 350 (177) | 350 (177) |
| Residence Time (sec.) | 48 | 58 | 67 |
| Dip Pick Up (%) | N/A | N/A | 11 |
| Size Change (mils) | N/A | N/A | +0.8 |

Results of adhesion testing comparing precoated with nonprecoated twisted strings are shown below:

| No. of Monofilaments Precoated* | Relaxed String Top-coated** | TPI of Relaxed String | Dip Pick Up % (Solids) | Adhesion lbs. |
|---|---|---|---|---|
| 0 | No | 3.5 | 0 | 0.7 |
| 0 | Yes | 3.5 | 11 | 1.0 |
| 1 (middle) | No | 3.5 | 3.5 | 1.4 |
| 3 (all) | No | 3.5 | 11 | 1.7 |
| 3 (all) | Yes | 3.5 | 18 | 1.9 |

*Monofilaments precoated with Genton® 110 from a 10% aqueous dispersion.
**Heat relaxed strings top-coated with 20% commercial urethane-latex from an aqueous dispersion.

From these data it is apparent that precoating only the middle monofilament at 3.5% pickup (3rd item) provided significantly better adhesion than 11% resin applied only after twisting without precoating (2nd item). Further improvements are realized upon precoating all the monofilaments with and without a topcoat.

EXAMPLE 2

This example demonstrates improvements needed in the twisting process to overcome problems encountered when twisting precoated monofilaments.

Using an apparatus substantially as represented in FIG. 1 and in Example 1 in which the cot roll surface is comprised of a hard elastomer such as Armstrong Accotex No. 728, twisting of three precoated monofilaments (prepared as in Ex. 1) to 2.9 tpi (114 turns per meter) gives nonuniform results and is difficult to control as described in Example 1. Attempted improvements by tension adjustments with the tension devices prove to be ineffective. However, when a thin layer of commercially available polytetrafluoroethylene coated fiberglass is placed around the stepped-down middle portion, 40, of the cot roll to reduce its surface friction and to allow uniform slippage of the middle precoated 3000 denier monofilament, twisting defects are substantially eliminated.

In another test with the apparatus and low friction cot roll as immediately above, and set for 1.7 tpi (66.9 turns per meter), after start up, all tension is removed from the middle monofilament. Tension on the two outer monofilaments is measured at 150–250 grams each. Increasing tension with the gate tension devices for the two outer monofilaments has no marked effect because twisting tension is controlled primarily by the cot roll/feed roll spindle system. Nipping by the cot roll isolates upstream tension effects. The tension on the middle monofilament is increased to about 200 grams; when this tension exceeds that of the outer monofilaments, the latter monofilaments overfeed resulting in entanglement in the roller slot guide.

In still another test, when the middle monofilament is allowed to by-pass the cot/feed rolls and directed directly from the tension device to the roller slot guide, the process runs well as long as its tension does not exceed that of the others.

EXAMPLE 3

This example describes a preferred process which provides a tennis string of small enough diameter for ease of stringing (even after top-coating and overbraiding) but yet of sufficient strength and durability in use as follows:

Monofilaments of poly(hexamethylene adipamide), 66-nylon, as described in Example 1 are used, but in this case each of the three monofilaments is of 3000 denier. All monofilaments are first precoated with "Elvamide" 8061 nylon resin by evaporation from a solution (about 10% resin in methyl alcohol). The resin added is 8±2% based on monofilament weight. Uniform application of the resin is assured by passing the monofil through appropriately sized dies (about 45 mils for 8 yards/minute monofilament speed) which strip off excess solution before the monofilament enters the evaporation ovens. Solvent evaporation and resin drying are accomplished by 40 seconds residence time in each of three radiant heat ovens (425° F., 218° C.). Ovens are vented to remove solvent fumes.

A Saco Lowell downtwister with monofilament twisting arrangement as illustrated in FIG. 1 is used with the middle portion of the cot roll (FIG. 2) covered with "Teflon" (polytetrafluoroethylene) coated fiberglass to provide low friction contact with the middle filament. This results in the middle filament being drawn into the roller slot guide at whatever speed is required for the filament dimensions at any given time. The tension of the middle filament is adjusted to be equal to or less than that of the outer filaments (150–200 grams) as described in Example 2. The only other change from Example 2 is to use smaller travelers (three PS 420 SZ 10J, Merriman) in order to accommodate a larger take up spool, thereby increasing productivity. The twisted strings (3000-3000-3000) are heat relaxed and cured without more adhesive in the No. 1 Litzler oven using the same conditions as described in Example 1. Strings prepared in this way give an adhesion test level which averages about 1.7 lbs. and are suitable for use in racquets directly or after top-coating and/or overbraiding as desired.

We claim:

1. An improved process for making an integrated twisted string comprised of a middle flattened monofilament sandwiched between two outer flattened monofilaments, with each monofilament having a denier within the range of 3,000 to 8,000 and two opposite flattened sides throughout its length including the steps of aligning the monofilaments edge-to-edge and forwarding them into a twisting zone through a slot guide having a slot width which is greater than the thickness of the thickest of the monofilaments to allow free passage of all monofilaments but less than the total thickness of two adjacent monofilaments or the width of a monofilament so that said monofilaments cannot cross over one another in said slot or back twist through the slot as they are forwarded into the twisting zone, compensating for the greater lengths required for the two outer monofilaments in the resulting twisted string configuration by separately controlling the speeds and tensions of the monofilaments on their way to said zone, twisting the monofilaments together in the twisting zone, and bonding them to one another by means of a heat-activated adhesive resin to form an integrated twisted string, wherein the improvement comprises the sequential steps of: (1) applying to the surface of at least the monofilament which is to become the middle monofilament a continuous dry thin coating of a heat-activated adhesive resin; (2) aligning the three monofilaments edge-to-edge in a common plane slightly separated from one another and with one monofilament positioned between the other two monofilaments and forwarding under separately controlled speeds and tensions the thus aligned and separated monofilaments into a twisting zone through said slot formed between two axially parallel freely-rolling cylindrical surfaces; (3) compensating for the excess length in the two outer monofilaments by forwarding them at a positively controlled speed and allowing the speed of the middle monofilament to be freely controlled by being drawn into the twisting zone through said slot at a relative rate determined by the speed of the two outer monofilaments and by the twisting action in said zone while maintaining a tension on the middle monofilament which is no greater than the tension maintained on each of the two outer monofilaments as they enter said zone so that the speed of the middle monofilament entering said zone is always slightly less by the required amount than that of the two outer monofilaments; (4) twisting said monofilaments together into a string in said zone in a sandwiched configuration with each flattened side of the twisted coated middle monofilament maintaining continuous contact throughout its length in the string with a flattened side of the corresponding adjacent outer monofilament; and (5) heating the twisted string under controlled tension at a temperature which activates said adhesive resin and bonds the monofilaments together.

2. A process of claim 1 wherein the monofilaments have a cross-section with a length-to-width ratio of from 2:1 to 4:1.

3. A process of claim 2 wherein the adhesive resin is applied to all three monofilaments prior to their being twisted.

4. A process of claim 3 including the step of applying an adhesive resin to the string after said twisting step.

* * * * *